United States Patent [19]

Kassai

[11] 4,364,576

[45] Dec. 21, 1982

[54] BABY WALKER

[75] Inventor: Kenzou Kassai, Osaka, Japan

[73] Assignee: Kassai Kabushikikaisha, Osaka, Japan

[21] Appl. No.: 202,177

[22] Filed: Oct. 29, 1980

[30] Foreign Application Priority Data

Oct. 31, 1979 [JP] Japan ..... 54-152218[U]

[51] Int. Cl.[3] ..... A47D 13/04

[52] U.S. Cl. ..... 280/87.02 W; 272/70.3; 272/DIG. 4; 280/87.05; 297/5; 297/136

[58] Field of Search ..... 272/73, 70.3, 70.4, 272/70, 142, DIG. 4, 85, 86; 297/5, 6, 136, 273, 274, 275, 276, 277, 278, 467, 468, 485; 280/7.1, 290, 647, 648, 649, 650, 87.02 W, 47.25, 47.38, 47.39, 47.4, 47.41

[56] References Cited

U.S. PATENT DOCUMENTS

| | | | |
|---|---|---|---|
| 74,596 | 2/1868 | Roberts | 24/134 R |
| 1,274,862 | 8/1918 | Erbach | 24/134 R |
| 1,535,071 | 4/1925 | Ward | 24/68 CT |
| 1,647,108 | 10/1927 | Hadley | 24/206 R X |
| 1,866,860 | 7/1932 | Pareira | 272/142 X |
| 3,429,537 | 2/1969 | Jantzen | 24/201 A X |
| 3,558,131 | 1/1971 | Dragon | 72/142 X |
| 3,837,048 | 9/1974 | Lewis et al. | 24/201 A |
| 3,863,303 | 2/1975 | Armstrong et al. | 24/134 KB X |
| 3,995,820 | 12/1976 | Einhorn | 24/134 R X |

FOREIGN PATENT DOCUMENTS

| | | | |
|---|---|---|---|
| 135317 | 11/1946 | Australia | 297/136 |
| 204688 | 12/1908 | Fed. Rep. of Germany | 272/142 |
| 622199 | 11/1935 | Fed. Rep. of Germany | 272/DIG. 4 |
| 972540 | 8/1950 | France | 24/201 R |
| 109207 | 3/1964 | Netherlands | 24/201 A |
| 509018 | 7/1939 | United Kingdom | 297/136 |

*Primary Examiner*—Richard C. Pinkham
*Assistant Examiner*—Arnold W. Kramer
*Attorney, Agent, or Firm*—W. G. Fasse; D. H. Kane, Jr.; D. F. Gould

[57] ABSTRACT

A baby walker is provided with a substantially doughnut-shaped upper frame and a seat suspended from the upper frame by three straps. The end of each strap is provided with an engaging bar disposed at right angles with the direction of the length of the strap. The opposite ends of the engaging bar project beyond the widthwise ends of the strap. Attached to the lower surface of the upper frame are adjusting members each having a plurality of downwardly opened recesses. A guide member is provided adjacent each adjusting member and spaced apart from the lower surface of the upper frame. The straps are led from below the upper frame and mounted on the upper surfaces of the guide members, with the ends of the straps being led to the adjusting members. Each engaging bar engages one of the associated engaging recesses. In this state, the load on the seat forces the engaging bars into the innermost regions of the engaging recesses.

12 Claims, 10 Drawing Figures

BABY WALKER

BACKGROUND OF THE INVENTION

1. Field of the Invention

The present invention relates to a baby walker and more particularly to improvements in a seat level adjusting mechanism for such baby walker.

2. Description of the Prior Art

Baby walkers have heretofore been used for a baby to learn to walk. In such walker, it is desirable that the level of the seat be adjustable to the growth of a baby. Further, since there are differences in the height of babies, it is desirable that the seat be adjustable to an optimum level for each particular baby.

The seat is held by a predetermined portion of the upper frame of a walker and usually suspended by suitable straps. Considering such a manner of holding the seat, it will be understood that adjustments of the seat level can be made by adjusting the length of the straps which suspend the seat. A certain conventional adjusting means for this purpose consists in folding a portion of the strap upon itself to provide an overlap and adjusting the length of said overlap so as to change the length of the strap. According to said means, the adjusted length is fixed by a clasp which frictionally acts on the strap.

The fixing method utilizing friction described above allows stepless adjustment of the length of the strap, so that it is advantageous in that any length adjusted in the whole range of the strap length can be fixed. However, the length adjusting means, which utilizes friction, tends to slip when subjected to heavy loads, causing the adjusted level of the seat to change with the frequency of use of the walker. Such slippage is also undesirable from the standpoint of safety if said slippage takes place when the baby is sitting on the seat.

On the other hand, the present situation in which the baby walker is actually used is such that even if the level of the seat can be adjusted steplessly, it is adjusted only two or three times as the baby grows. With this taken into consideration, it will be seen that the construction for a stepless adjustment utilizing friction is not an absolute necessity.

Further, where the seat is held by a predetermined portion of the upper frame and suspended by straps, the mechanism for adjusting the seat level by adjusting the length of the straps will be installed on the upper frame of the walker. The space available in said upper frame, however, is often insufficient for installation of said level adjusting mechanism. For example, whereas the front region of the upper frame is usually formed with a table section and has a relatively wide space, the rear region of the upper frame has a limited space in many cases. Thus, a level adjusting mechanism which is efficient in terms of its space requirement is desired.

SUMMARY OF THE INVENTION

Accordingly, a principal object of the present invention is to provide a baby walker which is capable of maintaining any adjusted level of the seat and hence superior in point of safety.

Another object of the invention is to provide a baby walker which is equipped with a level adjusting mechanism which can be efficiently installed in a limited space.

In a baby walker comprising an upper frame having an opening for receiving the torso of a baby, wheel means for movably supporting said upper frame with respect to the floor, and a seat disposed below said opening in said upper frame, the present invention is directed to a mechanism for adjusting the level of said seat. The arrangement of the invention is such that the seat is connected to straps and suspended from the upper frame by said straps and its level is adjusted by adjusting the effective length of said straps. The end of each strap is provided with an engaging bar which extends at right angles with the direction of the length of the strap. Engaging recesses engageable with said engaging bars are formed in adjusting members attached to the lower surface of the upper frame. The engaging recesses are open downwardly. The path along which each strap extends is defined by guide means. The guide means is in contact with a portion of the associated strap and guides, the latter in such a manner that when a load on the seat is transmitted to the strap, the guide means produces tension in the strap to force the engaging bar into the innermost region of the engaging recess. In this manner the positional relation between the engaging recesses and the guide means causes loads on the seat to thrust the engaging bars deeper into the engaging recesses. Thus, a seat level adjusting mechanism which is capable of establishing a safe and secure holding state is obtained. Further, the operation for adjusting the seat level is very simple.

In a preferred embodiment of the invention, the engaging recesses extend vertically. The guiding means includes a rotatable roller defining an upwardly directed surface which is located above the level of the uppermost ends of the engaging recesses. The roller is spaced apart from the lower surface of the upper frame and has the associated strap wrapped around a portion of the peripheral surface thereof. The roller is eccentrically and rotatably supported on a shaft so that when the larger-radius portion assumes the top position, the strap is clamped between the peripheral surface of the larger-diameter portion of the roller and the lower surface of the upper frame. The fixing of the strap is thereby rendered more firm.

In another preferred embodiment of the invention, each engaging recess has a shape which extends upwardly as an inverted-J shape. The guide means includes a guide opening defined by a cylindrical portion vertically extending from the upper frame, and the strap is received in the guide opening from above and its front end is drawn downwardly therethrough. The innermost region of said engaging recess curved as an inverted-J shape is located on the side where the guide opening is located. The diameter of said guide opening is less than the length of the engaging bar so that the latter can engage the end edge of said guide opening. In this manner the guide opening can form a part of the seat level adjusting mechanism.

DESCRIPTION OF THE PREFERRED EMBODIMENTS AND OF THE BEST MODE OF THE INVENTION

Figure 1:
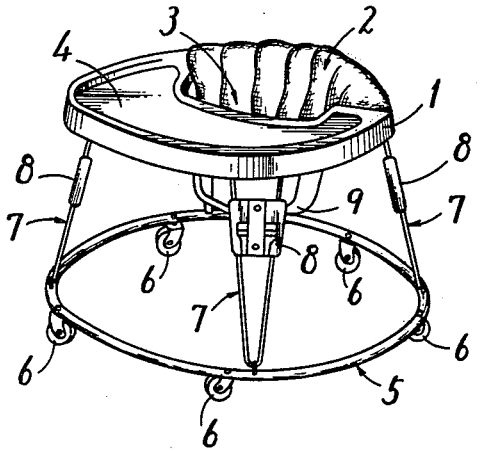
FIG. 1 is a complete perspective view of an embodiment of the present invention.

FIG. 1 is a complete perspective view of an embodiment of the invention. Referring to FIG. 1, arrangement of a baby walker will be described. The baby walker includes an upper frame 1. Suspended from the upper frame 1 is a seat structure 2 for supporting the upper half of the body of a baby. The upper frame 1 is formed with a table 4 while leaving an opening 3 forwardly or upwardly of the seat structure 2 for receiving the torso of a baby. Disposed below and parallel to the upper frame 1 is a lower frame 5 of, e.g., circular shape. The lower frame 5 is movably supported by a plurality (e.g., five) of casters 6 able to roll on the floor. The upper and lower frames 1 and 5 are connected together by a plurality (e.g., four) legs 7. The legs 7 are each formed with a collapsible portion 8 to establish a collapsed state in which the upper and lower frames 1 and 5 are brought close to each other.

Figure 3:
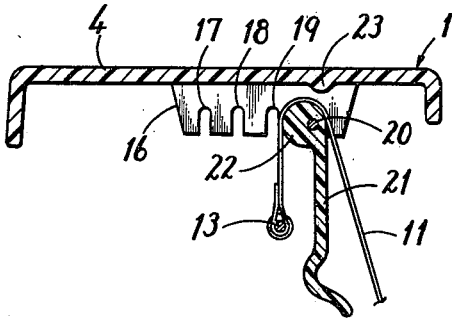
FIG. 3 is a sectional view showing the free state of a front, seat level adjusting mechanism defining the effective length of the front strap of the seat structure.
Figure 2:
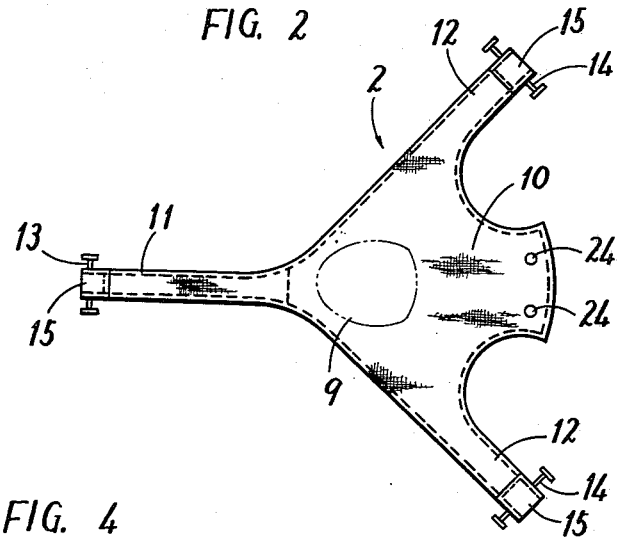
FIG. 2 is a top plan view of a seat structure shown in FIG. 1.
Figure 4:
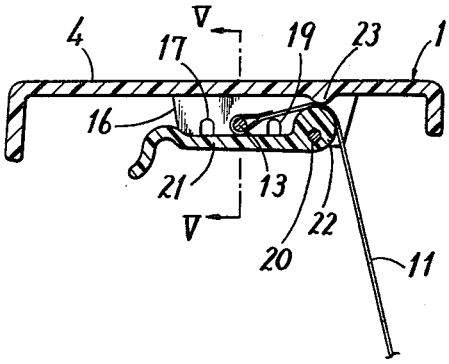
FIG. 4 is a sectional view showing a certain typical state in which the front, seat level adjusting mechanism of FIG. 3 holds the front strap.
Figure 5:
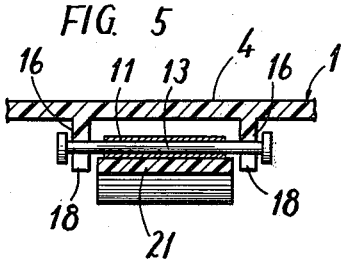
FIG. 5 is a sectional view taken along the line V—V of FIG. 4.

FIG. 2 is a developed or top plan view of the seat structure 2. FIGS. 3 to 5 are sectional views showing a front, seat level adjusting mechanism. FIG. 3 shows a not secured state; FIG. 4 shows a suspended, held state; and FIG. 5 is a sectional view taken along the line V—V of FIG. 4.

The seat structure 2 perspectively shown in FIG. 1 is made of a material having the shape shown in FIG. 2. Thus, it is made of a thick sheet, with a padding stuffed into a portion which forms a seat 9 and a cushioning material stuffed into a portion which forms a backrest 10. The end edge of the backrest portion 10 of the seat structure 2 is wrapped around the upper frame 1 and fixed to the latter, for example, by hooks 24. The level of the seat structure 2, particularly the seat 9, is adjustable in that a front strap 11 and rear straps 12, which extend in three directions, are adjustably attached to the upper frame 1. The ends of the front and rear straps 11 and 12 are fitted with front and rear engaging bars 13 and 14, respectively. Actually, the engaging bars 13 and 14 are held in loops 15 formed at the ends of the straps 11 and 12 by sewing. The opposite ends of each of the engaging bars 13 and 14 are formed with flanges to hold the bars in the respective loops.

FIGS. 3 to 5 show a portion to which said front strap 11 is attached. Adjusting members 16 are attached to the lower surface of the table portion 4 of the upper frame 1. The adjusting members 16 may be formed integrally with the upper frame 1 or these members may be formed separately and then secured to the upper frame as by screws. Each adjusting member 16 is formed with a plurality (e.g., three) engaging recesses 17, 18 and 19. These engaging recesses 17, 18 and 19 selectively receive an engaging bar 13. A lower receiving member 21 is rotatably installed on a shaft 20 supported in the adjusting members 16. The lower receiving member 21, as shown in FIGS. 4 and 5, operates to receive the engaging bar 13 from below after said bar has been received in, e.g., the engaging recess 18, thereby preventing the engaging bar 13 from slipping off or out of the engaging recess 18. The lower receiving member 21 is integrally formed with a roller or a guide member 22. The guide member 22 is eccentric with respect to the shaft 20, and in the state shown in FIG. 4 the larger-radius portion of the guide member 22 has assumed the top position. The front strap 11 is wrapped around the upwardly directed surface of the guide member 22. In the state in which the engaging bar 13 is engaged with an engaging recess, e.g., 18 as shown in FIG. 4, the upwardly directed surface of the guide member 22 is located above the level of the innermost regions of the engaging recesses 17, 18 and 19. As a result, a load on the seat structure 2 is supported by the strap 11 and such load is converted into a force which urges the engaging bar 13 into the innermost region of the engaging recess, e.g., 18. This ensures firm engagement of the engaging bar 13 with the engaging recesses 18, etc.

As described above, the eccentrically mounted guide member 22 is supported on the shaft 20. A projection 23 is formed on the lower surface of the upper frame 1 in opposed relation to the guide member 22. Therefore, when the larger-radius portion of the guide member 22 is not in the top position as shown in FIG. 3, it is possible for the strap 11 to slide along the guide member 22, while when the larger-radius portion of the guide member 22 is in the top position as shown in FIG. 4, the strap 11 is clamped between said larger-radius portion and said projection 23. This arrangement prevents slippage of the strap 11 and clamps the strap 11 between guide member 22 and the projection 23 the more firmly, the more strongly the strap is pulled. Moreover, the arrangement functions as means for fixing the lower receiving member 21 integrally formed on the guide member 22. That is, the lower receiving member 21 can be fixed in the state shown in FIG. 4 without requiring any separate or special fixing means.

The method of adjusting the level of the seat structure 2 or the length of the strap 11 by using the level adjusting mechanism shown in FIGS. 3 to 5 will now be described. The first step is to establish the not secured state shown in FIG. 3. The strap with its engaging bar is then engaged with any one of the engaging recesses 17, 18 or 19. These recesses are provided in pairs so that each end of a bar 13, 14 is received in a respective recess pair. For example, the central engaging recesses 18 may be engaged as shown in FIG. 4, and then the lower receiving member 21 is turned clockwise such that it is rather strongly turned near the end of the turning movement. As a result, the strap 11 is firmly clamped between the guide member 22 and the projection 23 and the lower receiving member is automatically fixed in a state for receiving the engaging bar 13 from below. Readjustment may be made by turning the lower receiving member 21 counter-clockwise from the state shown in FIG. 4 to the state shown in FIG. 3 and engaging the bar with a suitable engaging recess pair 17 or 19. When the engaging bar 13 engages the engaging recess pair 17, the strap 11 becomes shortest, while when the engaging bar 13 engages the engaging recess pair 19, the strap 11 becomes longest.

Figure 6:
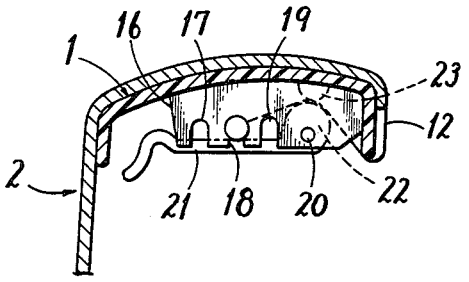
FIG. 6 is a side view, partly in section, showing a certain typical state assumed by a rear, seat level adjusting mechanism defining the effective length of a rear strap of the seat structure.

The level adjusting mechanism described above is used to adjust the front strap 11. The rear straps 12 can be similarly adjusted. Referring to FIG. 6, the rear straps 12 of the seat structure 2 are wrapped around the upper surface of the upper frame 1 and led to the lower surface of the upper frame 1. The lower surface of the upper frame 1 is provided with a rear seat level adjusting mechanism associated with the rear straps 12. The rear seat level adjusting mechanism shown in FIG. 6 has the same arrangement as the front seat level adjusting mechanism shown in FIGS. 3 to 5 and a description thereof is omitted, with the reference numerals used in FIG. 5 being applied to the corresponding parts.

In the embodiment described above, the seat structure 2 can be easily removed from the upper frame 1. That is, the engaging bars 13 and 14 attached to the ends of the straps 11 and 12 can be easily taken out of the loops 15. And the end edge of the backrest 10 of the seat structure 2 is adapted to be attached to the upper frame 1 as by hooks 24 (FIG. 2). Therefore, the seat structure 2, which can thus be easily removed, can be laundered.

In the embodiment described above, since the front and rear straps 11 and 12 radially extending in three directions are adjustable in length, it is possible to adjust the level of the seat portion 9 of the seat structure 2 while maintaining its attitude substantially horizontal.

Further, in the embodiment described above, since the lower receiving member 21 and guide member 22 are integrally constructed and since the guide member 22 is eccentrically supported on the shaft 20, loads on the straps 11 and 12 produce a force for clamping the straps more firmly and also provide means for fixing the lower receiving member 21. However, if such features are not desired, the guide member and the lower receiving member may be separately provided. In that case, the lower receiving member may be fixed to the upper frame 1 as by screws. If the eccentrically mounted guide member 22 is still supported by a shaft, it is possible to clamp the strap more firmly. However, the invention is not limited thereto, and the guide member may be in the form of a simple roller or a simple bar which is not rotatable.

Another embodiment of the invention to be presently described employs a seat level adjusting mechanism of space-saving construction for the rear straps 12. As already described, the rear region of the upper frame 1 is often limited in space and this arrangement is advantageous particularly in such a case.

Figure 7:
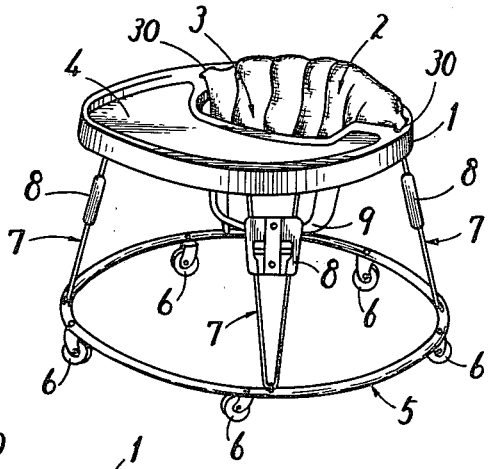
FIG. 7 is a complete perspective view of another embodiment of the invention.

FIG. 7 is a complete perspective view of another embodiment of the invention. The walker shown in FIG. 7 has almost the same external appearance as the one shown in FIG. 1, except for the following points. Referring to FIG. 7, the position of a guide opening 30 is diagrammatically shown in the rear region of the upper frame 1. The guide opening 30 forms part of the rear seat level adjusting mechanism.

Figure 8:
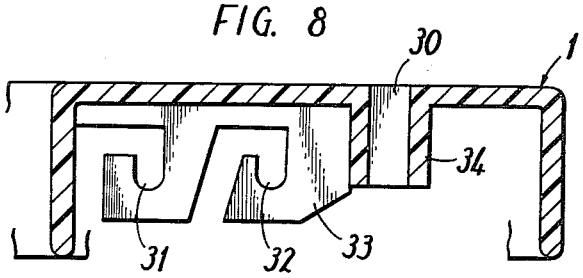
FIG. 8 is a sectional view showing only the arrangement of the rear seat level adjusting mechanism of the FIG. 7 embodiment associated with the upper frame.
Figure 9:
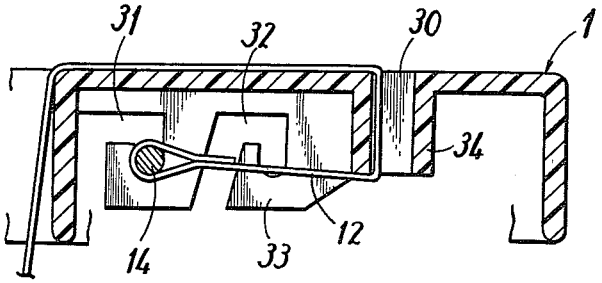
FIG. 9 is a sectional view showing a certain typical state in which the rear, seat level adjusting mechanism holds the rear strap.
Figure 10:
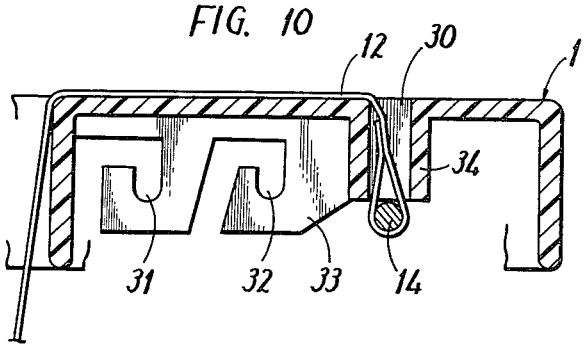
FIG. 10 is a sectional view showing another typical state in which the rear, seat level adjusting mechanism of FIG. 8 holds the rear strap.

FIGS. 8 through 10 are sectional views showing the rear, seat level adjusting mechanism. FIG. 8 shows only the arrangement on one side of the upper frame 1; FIG. 9 shows a certain typical seat holding state; and FIG. 10 shows another typical seat holding state. Referring to FIGS. 8 to 10, downwardly open engaging recesses 31 and 32 are disposed adjacent a guide opening 30 defined by a cylindrical body 34 and below the lower surface of the upper frame 1. The engaging recesses 31 and 32 are curved to have an inverted-J shape, and the innermost region of the shape is located on the side where the guide opening 30 is provided. The rib-like adjusting members 33 having said engaging recesses are parallel to each other as in the case of said adjusting members 16 shown in FIG. 5.

The rear straps 12 are received in the guide openings 30 from above and pulled downwardly through the openings 30. The ends of the rear straps 12 are each provided with a rear engaging bar 14 like the bar 13 already described. The diameter of the guide openings 30 is less than the length of the rear engaging bars 14.

FIG. 9 shows the rear engaging bar 14 engaged with the first pair of engaging recess 31. In this case, a downward load on the seat structure 2 and particularly on the seat 9 acts in a direction which pulls the rear strap 12 and this force acts in a direction which prevents the rear engaging bar 14 from slipping off from the engaging recess pair 31. The rear engaging bar 14 can be removed from the first engaging recesses 31 by lightly loosening the rear strap 12. It is possible to engage the rear engaging bar 14 with the second engaging recesses 32 in the same manner. In this case, the level of the seat structure 2, particularly the seat 9, is lower than before. If the rear engaging bar 14 is removed from the second engaging recesses 32 and then the seat 9 is depressed, the rear engaging bar 14 abuts against the lower end surface of the guide opening 30, as shown in FIG. 10. In this state, the seat 9 assumes a further lowered level. That is, the guide opening 30 also acts as a seat level adjusting mechanism. In cases where the available space is limited as in the rear region of the upper frame 1 and where there is no room for installing the seat level adjusting mechanism, the fact that the guide opening 30 can also be utilized as part of the seat level adjusting mechanism is very advantageous.

In connection with the preceding embodiment, it is to be noted that even if the number of engaging recesses 31 and 32 is increased or decreased to one, the advantage of using the guide opening 30 as a stop still applies. Further, an arrangement comprising, in combination, the front seat level adjusting mechanism shown in FIGS. 3 to 5 and the guide opening 30 is also possible. Although the rear seat level adjusting mechanism described with reference to FIGS. 8 to 10 has been shown in association with the rear strap a similar mechanism may be provided in association with the front strap.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baby walker comprising: an upper frame disposed at a predetermined distance from the floor and having an opening for receiving the torso of a baby, wheel holding means including wheels adapted to roll along the floor for movably supporting said upper frame with respect to the floor, adjusting members attached to the lower surface of said upper frame, each adjusting member having a plurality of pairs of engaging recesses which are opening downwardly and which are transversely arranged, a seat disposed below said opening in said upper frame, straps for suspending said seat from said upper frame, said straps being connected at one of their respective ends to said seat, engaging bars installed at the other ends of said straps at right angles to the direction of the length of said straps and adapted to engage any one of said pairs of engaging recesses of its associated adjusting member, and guide means which contacts part of an associated strap to define the path along which said strap extends, said guide means being arranged so that when a load on said seat is transmitted to the strap, a tension is exerted on said strap to force said engaging bar ends into the innermost regions of said pair of engaging recesses.

2. A baby walker as set forth in claim 1, wherein said engaging recesses extend vertically.

3. A baby walker as set forth in claim 2, wherein said guide means defines an upwardly directed surface located above the level of the uppermost ends of said pairs of engaging recesses, and wherein said strap is mounted on said upwardly directed surface of said guide means.

4. A baby walker as set forth in claim 3, wherein said guide means includes a rotatably supported roller spaced apart from the lower surface of said upper frame, and wherein a portion of said roller forms an upwardly directed surface.

5. A baby walker as set forth in claim 4, wherein said roller is eccentrically and rotatably supported on a shaft, whereby a larger-radius portion of said roller is movable into a top position for clamping said strap between the lower surface of said upper frame and the peripheral surface portion of said larger-radius portion of said roller.

6. A baby walker as set forth in claim 5, further including a lower receiving member adapted to support said engaging bar received in any one of said pair of engaging recesses, from below.

7. A baby walker as set forth in claim 6, wherein said lower receiving member is integral with said roller and extends radially from the peripheral surface of said roller in such a direction that when said larger-radius portion of said roller assumes the top position, said lower receiving member extends along and under said plurality of pairs of engaging recesses.

8. A baby walker as set forth in claim 1, wherein said engaging recesses extend from below to assume an inverted-J shape.

9. A baby walker as set forth in claim 8, wherein said guide means causes said strap to extend in a direction which pulls the associated bar ends into the innermost regions of the engaging pairs of recesses curved in inverted-J shape.

10. A baby walker as set forth in claim 9, wherein said guide means includes a guide opening defined by a vertically extending cylindrical portion formed on said upper frame, and wherein said strap is received in said guide opening from above to extend downwardly through said guide opening.

11. A baby walker as set forth in claim 10, wherein the innermost regions of the engaging recesses having an inverted-J shape are located on the side where said guide opening is provided.

12. A baby walker comprising: an upper frame disposed at a predetermined distance from the floor and having means which defines an opening for receiving the torso of a baby, wheel holding means including wheels adapted to roll along the floor and to movably support said upper frame with respect to the floor, adjusting members attached to the lower surface of the upper frame and each having a plurality of pairs of downwardly opened and transversely arranged engaging recesses, a seat disposed below said opening in said upper frame, straps suspending said seat from said upper frame and connected at one of their respective ends to said seat, an engaging bar provided at the other end of each of said straps at right angles relative to the direction of the length of the strap, and guide opening means provided on said upper frame for respectively receiving said straps therein from above, said straps extending downwardly through said guide opening means, each guide opening having a diameter smaller than the length of said associated engaging bar, and wherein said engaging bar ends are forced into the innermost recesses of their associated pair of adjusting members when tension is exerted on said straps.

* * * * *